US009719296B1

(12) United States Patent
Lynch et al.

(10) Patent No.: US 9,719,296 B1
(45) Date of Patent: Aug. 1, 2017

(54) APPARATUSES AND SYSTEMS FOR SELECTIVELY LOCKING LIFT CORDS USED TO LIFT ARCHITECTURAL OPENING COVERINGS

(71) Applicant: SAFE-T-SHADE, Huntersville, NC (US)

(72) Inventors: William Lynch, Cornelius, NC (US); William D Feather, Salisbury, NC (US); Steve Gibbons, Waxhaw, NC (US)

(73) Assignee: SAFE-T-SHADE, Huntersville, NC (US)

( * ) Notice: Subject to any disclaimer, the term of this patent is extended or adjusted under 35 U.S.C. 154(b) by 0 days.

(21) Appl. No.: 14/875,946

(22) Filed: Oct. 6, 2015

Related U.S. Application Data

(60) Provisional application No. 62/060,361, filed on Oct. 6, 2014.

(51) Int. Cl.
*E06B 9/325* (2006.01)
*E06B 9/324* (2006.01)
(Continued)

(52) U.S. Cl.
CPC ..... *E06B 9/324* (2013.01); *E06B 9/262* (2013.01); *E06B 9/325* (2013.01); *E06B 9/326* (2013.01)

(58) Field of Classification Search
CPC .. E06B 9/324; E06B 9/326; E06B 2009/3265; E06B 2009/2622;
(Continued)

(56) References Cited

U.S. PATENT DOCUMENTS 1,962,964 A 6/1934 Morrison
2,226,393 A 12/1940 Seeger et al.
(Continued)

FOREIGN PATENT DOCUMENTS

CA 2201209 A1 9/1998
FR 2785639 A1 5/2000
(Continued)

OTHER PUBLICATIONS

Author Unknown, "On," Dictionary.com, accessed Jun. 29, 2014, http://dictionary.reference.com/browse/on, Random House, Inc., 1 page.

(Continued)

*Primary Examiner* — Katherine Mitchell
*Assistant Examiner* — Johnnie A Shablack

(57) ABSTRACT

Apparatuses and systems for selectively locking a lift cord designed to lift coverings for architectural openings is disclosed. The apparatus may comprise a selective locking member and a base member positioned at a bottom of an architectural opening covering. The base member and the selective locking member each have an opening through which a lift cord may pass. The selective locking member also has at least one edge configured to mate to a bottom of a groove in the base member. The selective locking member is configured to selectively engage the base member and the lift cord such that the selective locking member can be selectably moved between an open position, where the lift cord can be freely moved, and a closed position, wherein the selective locking member will pinch the lift cord between itself and the base member and prevent the lift cord from being moved.

22 Claims, 12 Drawing Sheets

(51) Int. Cl.
*E06B 9/326* (2006.01)
*E06B 9/262* (2006.01)

(58) Field of Classification Search
CPC ..... Y10T 24/3984; Y10T 24/3936; Y10T 24/3953; F16G 11/00; F16G 10/00; F16G 11/101
USPC ..... 160/84.04, 84.01, 84.05, 168.1 R, 340, 160/388
See application file for complete search history.

(56) References Cited

U.S. PATENT DOCUMENTS 2,410,549 A 11/1946 Olson
2,557,877 A 6/1951 Kluson
2,577,046 A 12/1951 Svirsky
2,845,674 A * 8/1958 Pearson ..... F16G 11/10 24/134 KB
3,022,819 A 2/1962 Lampret
3,633,646 A 1/1972 Zilver
3,795,267 A 3/1974 Debs
3,799,236 A 3/1974 Debs
4,352,386 A 10/1982 Butler et al.
4,635,698 A * 1/1987 Anderson ..... E06B 9/326 160/178.2
4,685,502 A 8/1987 Spangenberg
4,722,383 A 2/1988 Kross
4,807,683 A 2/1989 Hennequin et al.
4,811,466 A * 3/1989 Zubli ..... E06B 9/324 160/178.2
4,817,698 A 4/1989 Rossini et al.
4,865,108 A 9/1989 Hennequin et al.
4,865,109 A 9/1989 Sherman
5,070,805 A 12/1991 Plante
5,273,069 A 12/1993 Akiyama et al.
5,273,096 A 12/1993 Thomsen et al.
5,315,741 A 5/1994 Dubberke
5,365,641 A 11/1994 Watanabe et al.
5,463,797 A 11/1995 Laug et al.
5,465,775 A 11/1995 Biba et al.
5,465,779 A 11/1995 Rozon
5,472,035 A 12/1995 Biba et al.
5,501,262 A 3/1996 Inaba et al.
5,513,687 A 5/1996 Tuzmen et al.
5,553,649 A 9/1996 Chisaka et al.
5,553,653 A 9/1996 Rozon
5,595,232 A 1/1997 Benthin
5,645,685 A 7/1997 Furhman
5,657,513 A 8/1997 Takahashi
5,657,807 A 8/1997 Hsu
5,666,699 A 9/1997 Takahashi
5,671,793 A 9/1997 Lee
5,706,876 A 1/1998 Lysyj
5,709,258 A 1/1998 Coccoluto
5,722,478 A 3/1998 Claypool et al.
5,749,405 A 5/1998 Huang
5,752,558 A 5/1998 Lin
5,797,441 A 8/1998 Benthin
5,819,832 A 10/1998 Huang
5,850,863 A 12/1998 Huang
5,862,850 A 1/1999 Yang
5,904,198 A 5/1999 Huang
6,058,575 A * 5/2000 Dagan ..... F16G 11/046 24/115 M
6,062,292 A 5/2000 Bryant
6,164,291 A 12/2000 Filippone
6,189,595 B1 2/2001 Lee
6,196,293 B1 3/2001 Lee
6,463,987 B1 10/2002 Nevins
6,477,748 B2 11/2002 Steiner
6,516,860 B1 2/2003 Weaver et al.
6,591,461 B2 7/2003 Salentine et al.
6,601,633 B2 8/2003 Sun et al.
6,644,374 B2 11/2003 Nien
6,680,594 B2 1/2004 Collett et al.
6,685,592 B2 2/2004 Fraczek et al.
6,752,194 B1 6/2004 Huang
6,792,995 B2 9/2004 Judkins
6,817,399 B2 11/2004 Berman et al.
6,948,216 B2 9/2005 Gaudyn et al.
7,036,547 B1 5/2006 Cheng et al.
7,117,920 B2 10/2006 Dekker et al.
7,124,801 B2 10/2006 Ng et al.
7,204,292 B2 4/2007 Nien
7,261,138 B2 8/2007 Judkins et al.
7,337,503 B1 3/2008 Ashbrook
7,464,742 B2 12/2008 Oskam et al.
7,597,131 B2 10/2009 Nien et al.
7,624,784 B2 12/2009 Anthony et al.
7,669,633 B2 3/2010 Berger
7,770,625 B2 8/2010 Lukos
7,775,254 B2 8/2010 Judkins et al.
7,832,450 B2 11/2010 Brace et al.
7,938,161 B2 5/2011 Lin
8,091,606 B2 1/2012 Nien et al.
8,113,261 B2 2/2012 Lin
8,205,316 B2 6/2012 Chu
8,220,517 B2 7/2012 Kollman et al.
8,225,463 B2 7/2012 Bourke et al.
8,245,360 B2 8/2012 Stafford et al.
8,256,489 B2 9/2012 Berger
8,267,144 B2 9/2012 Hsu et al.
8,281,842 B2 10/2012 Lin
8,286,686 B2 10/2012 Cannaverde
8,291,959 B2 10/2012 Cheng
8,316,911 B2 11/2012 Cleaver
8,356,653 B2 1/2013 Fu-Lai et al.
8,365,362 B2 2/2013 Chou
8,381,792 B2 2/2013 Perkowitz
8,474,509 B2 7/2013 Koop
8,499,815 B2 8/2013 Zhang
8,511,363 B2 8/2013 Lin
8,540,006 B1 9/2013 Vestal et al.
8,544,525 B2 10/2013 Zhu
8,550,141 B2 10/2013 Ding
8,763,671 B2 7/2014 Vestal
8,763,675 B2 7/2014 Zhu
8,950,463 B2 2/2015 Vestal et al.
8,967,226 B2 3/2015 Vestal
9,045,934 B1 * 6/2015 Lynch ..... E06B 9/322
9,149,143 B2 10/2015 Vestal
9,151,110 B2 10/2015 Vestal et al.
9,187,952 B2 11/2015 Vestal et al.
9,206,639 B2 * 12/2015 Chen ..... E06B 9/324
2003/0192654 A1 10/2003 Nien
2003/0192655 A1 10/2003 Nien
2003/0201076 A1 10/2003 Nien
2004/0003900 A1 1/2004 Nien
2004/0108080 A1 6/2004 Nien
2004/0200583 A1 10/2004 Nien
2005/0109468 A1 5/2005 Hsu
2006/0157204 A1 7/2006 Lin
2006/0243402 A1 11/2006 Chang
2007/0023149 A1 2/2007 Lamars et al.
2007/0235147 A1 10/2007 Zakowski et al.
2008/0083511 A1 4/2008 Hung
2009/0064473 A1 3/2009 Chan
2009/0071610 A1 3/2009 Bossler
2010/0101741 A1 4/2010 Koop
2010/0126673 A1 5/2010 Lin
2010/0126674 A1 5/2010 Lin
2010/0126679 A1 5/2010 Lin
2010/0193141 A1 8/2010 Liang et al.
2010/0212120 A1 8/2010 LeBlanc
2010/0257701 A1 10/2010 Gammell et al.
2010/0269984 A1 10/2010 Hanley et al.
2010/0269985 A1 10/2010 Hanley et al.
2010/0294438 A1 11/2010 Kirby et al.
2010/0326608 A1 12/2010 Wen et al.
2011/0036512 A1 2/2011 Su
2011/0048652 A1 3/2011 Chen
2011/0056633 A1 3/2011 Lin
2011/0067820 A1 3/2011 Hsu et al.
2011/0073260 A1 3/2011 Kollman et al.

(56) References Cited

U.S. PATENT DOCUMENTS

| | | | | |
|---|---|---|---|---|
| 2011/0083816 | A1 | 4/2011 | Chen | |
| 2011/0107557 | A1 | 5/2011 | Bourke et al. | |
| 2011/0108206 | A1 | 5/2011 | Hsu et al. | |
| 2011/0132554 | A1 | 6/2011 | Lin | |
| 2011/0146429 | A1 | 6/2011 | Vestal | |
| 2011/0146918 | A1 | 6/2011 | Vestal | |
| 2011/0168339 | A1 | 7/2011 | Bowen et al. | |
| 2011/0192549 | A1 | 8/2011 | Wen et al. | |
| 2011/0192550 | A1 | 8/2011 | Williams, III | |
| 2011/0192557 | A1 | 8/2011 | Ling | |
| 2011/0247761 | A1 | 10/2011 | Lin | |
| 2011/0247762 | A1 | 10/2011 | Lin | |
| 2011/0247763 | A1 | 10/2011 | Hu et al. | |
| 2011/0247765 | A1 | 10/2011 | Lin | |
| 2011/0259534 | A1 | 10/2011 | Vestal et al. | |
| 2011/0283485 | A1 | 11/2011 | Vestal et al. | |
| 2011/0297336 | A1 | 12/2011 | Chen | |
| 2011/0297337 | A1 | 12/2011 | Chen | |
| 2011/0308745 | A1 | 12/2011 | Vestal et al. | |
| 2012/0060329 | A1* | 3/2012 | Zhang | E06B 9/384 24/115 F |
| 2012/0067527 | A1 | 3/2012 | Cheng | |
| 2012/0097342 | A1 | 4/2012 | Tu | |
| 2012/0097343 | A1 | 4/2012 | O'Hair | |
| 2012/0267056 | A1 | 10/2012 | Ko | |
| 2012/0285634 | A1 | 11/2012 | Zhu | |
| 2013/0068405 | A1 | 3/2013 | Lava et al. | |
| 2014/0000822 | A1 | 1/2014 | Vestal | |
| 2014/0374034 | A1* | 12/2014 | Corey | E06B 9/262 160/170 |
| 2014/0374038 | A1* | 12/2014 | Chen | E06B 9/324 160/370 |
| 2015/0068689 | A1* | 3/2015 | Zhang | E06B 9/384 160/178.2 |
| 2016/0053532 | A1* | 2/2016 | Zhang | E06B 9/262 160/84.04 |

FOREIGN PATENT DOCUMENTS

| | | | | |
|---|---|---|---|---|
| GB | 2531911 A * | 5/2016 | | E06B 9/326 |
| GB | 2535271 A * | 8/2016 | | E06B 9/262 |

OTHER PUBLICATIONS

First Examination Report for New Zealand patent application 610332 mailed May 10, 2013, 2 pages.
Further Examination Report for New Zealand Patent Application No. 610332, mailed Aug. 15, 2014, 2 pages.
Extended European Search Report for European patent application 13166761.0 mailed Apr. 1, 2014, 11 pages.
International Search Report for PCT/US2010/062057 mailed Oct. 27, 2011, 20 pages.
International Preliminary Report on Patentability for PCT/US2010/062057 mailed Jul. 4, 2013, 14 pages.
International Search Report for PCT/US2011/026410 mailed May 3, 2012, 13 pages.
International Search Report for PCT/US2012/034984 mailed Jul. 13, 2012, 9 pages.
International Preliminary Report on Patentability for PCT/US2012/034984 mailed Nov. 7, 2013, 7 pages.
International Search Report for PCT/US2012/034990 mailed Jul. 20, 2012, 9 pages.
International Preliminary Report on Patentability for PCT/US2012/034990 mailed Nov. 7, 2013, 7 pages.
Partial European Search Report for European patent application 13166761.0 mailed Nov. 20, 2013, 8 pages.
Notice of Allowance and Applicant-Initiated Interview Summary for U.S. Appl. No. 12/976,677 mailed Dec. 29, 2014, 10 pages.
Non-final Office Action for U.S. Appl. No. 12/976,677 mailed Nov. 19, 2013, 10 pages.
Final Office Action for U.S. Appl. No. 12/976,677, mailed Jul. 9, 2014, 16 pages.
Non-final Office Action for U.S. Appl. No. 13/094,727 mailed Aug. 29, 2012, 10 pages.
Final Office Action for U.S. Appl. No. 13/094,727 mailed Jul. 17, 2014, 12 pages.
Non-final Office Action for U.S. Appl. No. 12/976,732 mailed Nov. 19, 2012, 14 pages.
Non-final Office Action for U.S. Appl. No. 13/035,222 mailed Jan. 2, 2013, 6 pages.
Final Office Action for U.S. Appl. No. 13/035,222 mailed Jul. 17, 2013, 5 pages.
Non-final Office Action for U.S. Appl. No. 13/035,222 mailed Apr. 17, 2014, 7 pages.
Final Office Action for U.S. Appl. No. 13/035,222, mailed Oct. 1, 2014, 6 pages.
Advisory Action for U.S. Appl. No. 13/035,222, mailed Jan. 14, 2015, 3 pages.
Non-Final Office Action for U.S. Appl. No. 13/035,222, mailed Apr. 3, 2015, 5 pages.
Notice of Allowance for U.S. Appl. No. 13/035,222, mailed Sep. 10, 2015, 8 pages.
Non-final Office Action for U.S. Appl. No. 13/094,705 mailed Jan. 14, 2013, 6 pages.
Final Office Action for U.S. Appl. No. 13/094,705 mailed Jul. 18, 2013, 6 pages.
Non-Final Office Action for U.S. Appl. No. 13/094,705 mailed May 29, 2014, 6 pages.
Final Office Action for U.S. Appl. No. 13/094,705 mailed Oct. 28, 2014, 9 pages.
Advisory Action for U.S. Appl. No. 13/094,705, mailed Apr. 7, 2015, 3 pages.
Notice of Allowance for U.S. Appl. No. 13/094,705, mailed Aug. 4, 2015, 8 pages.
Non-Final Office Action for U.S. Appl. No. 14/021,181 mailed Oct. 30, 2014, 8 pages.
Notice of Allowance for U.S. Appl. No. 14/021,181, mailed Jun. 24, 2015, 8 pages.
Non-final Office Action for U.S. Appl. No. 13/738,387 mailed May 13, 2013, 15 pages.
Notice of Allowance for U.S. Appl. No. 13/738,387 mailed Jul. 10, 2013, 9 pages.
Notice of Allowance and Applicant-Initiated Interview Summary for U.S. Appl. No. 13/094,727 mailed Oct. 31, 2014, 9 pages.
Non-final Office Action for U.S. Appl. No. 13/094,727 mailed Apr. 10, 2013, 13 pages.
Non-final Office Action for U.S. Appl. No. 13/094,727 mailed Nov. 25, 2013, 10 pages.
Final Office Action for U.S. Appl. No. 12/976,732 mailed Jun. 25, 2013, 16 pages.
Non-final Office Action for U.S. Appl. No. 12/976,732 mailed Dec. 18, 2013, 12 pages.
Notice of Allowance for U.S. Appl. No. 12/976,732, mailed May 1, 2014, 8 pages.
Patent Examination Report No. 1 for Australian Patent Application No. 2013205748, issued Sep. 19, 2016, 3 pages.
First Office Action for Canadian Patent Application No. 2,785,483, mailed Aug. 5, 2016, 3 pages.
Non-Final Office Action for U.S. Appl. No. 14/942,222, mailed Mar. 30, 2017, 10 pages.
Patent Examination Report No. 2 for Australian Patent Application No. 2013205748, issued Feb. 8, 2017, 2 pages.

* cited by examiner

APPARATUSES AND SYSTEMS FOR SELECTIVELY LOCKING LIFT CORDS USED TO LIFT ARCHITECTURAL OPENING COVERINGS

RELATED APPLICATIONS

The present application claims priority to U.S. Provisional Patent Application No. 62/060,361, entitled "Apparatuses and Systems for Selectively Locking Lift Cords Used to Lift Architectural Opening Coverings," filed on Oct. 6, 2014, which is incorporated herein by reference in its entirety.

This application is related to U.S. patent application Ser. No. 12/976,732, filed Dec. 22, 2010, entitled "Cordless Covering for Architectural Opening", now issued as U.S. Pat. No. 8,763,671, which is incorporated herein by reference in its entirety.

This application is also related to U.S. patent application Ser. No. 12/976,677, filed Dec. 22, 2010, entitled "Architectural Cover Operating Assembly," now issued as U.S. Pat. No. 8,967,226, which is incorporated herein by reference in its entirety.

This application is also related to U.S. patent application Ser. No. 13/035,222, filed Feb. 25, 2011, entitled "Cordless Blind System and Retro-Fit Method", now issued as U.S. Pat. No. 9,187,952, which is incorporated herein by reference.

This application is also related to U.S. patent application Ser. No. 13/094,705, filed Apr. 26, 2011, entitled "Cordless Blind System and Retro-Fit Method", now issued as U.S. Pat. No. 9,151,110, which is incorporated herein by reference.

This application is also related to U.S. patent application Ser. No. 13/094,727, filed Apr. 26, 2011, entitled "Cordless Coverings for Architectural Opening Having Cord Enclosures with a Swivel Feature and Methods of Assembling Such Cord Enclosures", now issued as U.S. Pat. No. 8,950,463, which is incorporated herein by reference.

This application is also related to U.S. patent application Ser. No. 13/738,387, filed Jan. 10, 2013, entitled "Apparatuses, Systems and Methods for Locking Lift Cords Used to Lift Architectural Opening Coverings", now issued as U.S. Pat. No. 8,540,006, which is incorporated herein by reference.

This application is also related to U.S. patent application Ser. No. 14/021,181, filed Sep. 9, 2013, entitled "Apparatuses, Systems and Methods for Locking Lift Cords Used to Lift Architectural Opening Coverings", now issued as U.S. Pat. No. 9,149,143, which is incorporated herein by reference.

This application is also related to U.S. patent application Ser. No. 14/312,432, filed Jun. 23, 2014, entitled "Devices and Systems for Accumulating Lift Cords Used to Lift Architectural Opening Coverings", now issued as U.S. Pat. No. 9,045,934, which is incorporated herein by reference.

FIELD OF THE DISCLOSURE

Embodiments disclosed herein include apparatuses, systems, and methods for selectably locking lift cords, particularly lift cords for coverings for architectural openings. In particular, a selectable locking mechanism is disclosed that can be used with lift cords for architectural coverings, such as a shade, to allow an adjusting of a length of the lift cord, to avoid having a hazardous loop formed by the lift cord, and to help keep the architectural covering level.

BACKGROUND

In the use of window and architectural passage coverings, the art has long relied on cords, string or the like to extend and retract the coverings. Such coverings take many forms, including shades such as curtains, roll-up shades, Venetian blinds, vertical blinds, cellular shades, and the like. One problem with such coverings that rely on cords is that small children can become entangled in the cords and experience serious harm, including strangulation and death. On Aug. 26, 2009, the U.S. Consumer Product Safety Commission announced a voluntary recall of all ¼ inch Oval Roll-up Blinds and Woolrich Roman Shades, including some 4.2 million roll-up blinds and 600,000 Roman shades, (http://www.cpsc.gov/cpscpub/prerel/prhtm109/09324.html). The U.S. Consumer Product Safety Commission referenced the hazard that "[s]trangulations can occur if the lifting loops slide off the side of the blind and a child's neck becomes entangled on the free-standing loop or if a child places his/her neck between the lifting loop and the roll-up blind material." Recent cited injuries include a report that "[i]n November 2007, a 1-year-old boy from Norridgewock, Me. became entangled and strangled in the lift cord loop of a roll-up blind that had fallen into his portable crib. In October 2008, a 13-month-old boy from Conway, Ark. was found with his head between the exposed inner cord and the cloth on the backside of a Roman shade. The cord was not looped around the boy's neck but rather ran from ear to ear and strangled the child." Numerous manufacturers and retailers have followed their call. Additional information may be found at: (http://www.windowcoverings.org).

In addition to the internal cords attached to the shade or blinds that can be pulled out and pose a problem, the pull cords, string, and beaded cords in mechanical based blinds and shades that are pulled on to draw up the blinds or shades also pose a risk since they also create a hazardous loop of sufficient diameter (12 inches per the U.S. Consumer Product Safety Commission) for a small child to get their head tangled inside. Some industry standards consider a loop of seven and one half inches to be hazardous. Even the retrofit devices currently available (http://www.windowcoverings.org/how_to_retrofit.html) do not eliminate the hazardous loops created by the beaded cords even if they are tied to the wall with a tie-down device such as a Rollease™ product or with separated draw strings and/or cord stops that could still become tangled together to create a hazardous loop.

Another problem with architectural opening coverings that use cords, string or the like to extend and retract the coverings is that the cords get tangled and the architectural opening covering does not remain level. If the cords are not capable of being easily and smoothly adjusted when the architectural covering opening is lifted up and down, the cords will get tangled, which may cause the architectural covering opening to become twisted and not level, i.e, one side of the architectural covering opening will be higher or lower than the other side.

In consequence, the art is in need of improvement in coverings for architectural openings that maintains the functionality and aesthetics of previously developed coverings, but avoids their deficiencies, particularly their hazardous character as regards the risk of injury or death associated with the use of cord arrangements. The art also is in need of a new mechanism to allow the lifting of shades without creating a hazardous loop. The art is further in need of a way that the cords, string, or the like used to extend and retract the coverings can be selectably adjusted without getting tangled, so that the architectural opening covering will remain level.

SUMMARY

Embodiments disclosed in the present Specification relate to an apparatus for selectively locking a lift cord configured to raise or lower a covering for an architectural opening, such as a window, door, or the like. In particular, embodiments disclosed in the present description relate to a selective locking member to be used in conjunction with a base member positioned at a bottom of a covering for an architectural opening, such as a window, door, portal, or the like. The selective locking member is configured to selectively engage the base member and the lift cord. The selective locking member has an opening through which the lift cord may pass. The base member also has at least one opening through which the lift cord may pass. The selective locking member has at least one edge configured to engage a bottom of a groove in the base member. The selective locking member is configured to engage the base member and the lift cord in such a way that the selective locking member can be selectably moved into an open position or a closed position. When the selective locking member is in the open position, the lift cord can be freely moved. When the selective locking member is in the closed position, the selective locking member will pinch the lift cord between the locking member and the base member so that the lift cord is prevented from being moved.

In yet another embodiment, a system for selectively locking a lift cord designed to lift coverings for architectural openings is disclosed. The system comprises a covering for an architectural opening that is configured to be attached to a head rail and to be raised or lowered by at least one lift cord. The system also includes a selective locking member and a base member, each having at least one opening configured to receive the at least one lift cord. In one embodiment, the selective locking member and a base member are located near a bottom end of the architectural opening covering. The selective locking member is configured to selectively engage the base member and the lift cord. The selective locking member has at least one edge configured to engage a bottom of a groove in the base member. The selective locking member is configured to engage the base member and the lift cord in such a way that the selective locking member can be selectably moved into an open position or a closed position. When the selective locking member is in the open position, the lift cord can be freely moved and adjusted. When the selective locking member is in the closed position, the selective locking member will pinch the lift cord between the locking member and the base member so that the lift cord is prevented from being moved.

Other aspects, features, and embodiments will be more fully apparent from the ensuing disclosure and appended claims.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

Figure 7:
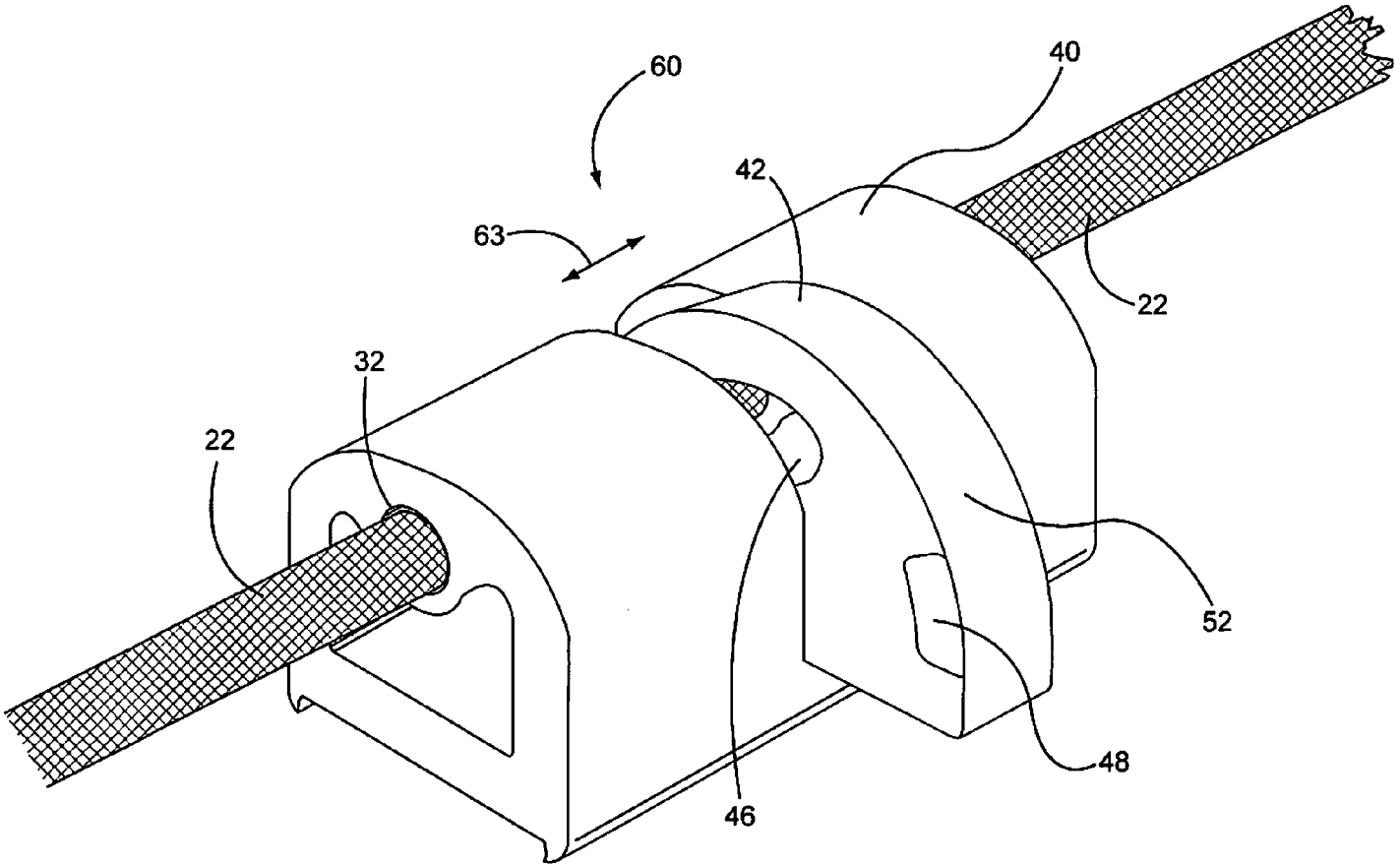
FIG. 7 is a close up representative side view of an exemplary lift cord, an exemplary base member, and an exemplary selective locking member, illustrating the exemplary selective locking member disengaged from the base member in an open position.
Figure 8A:
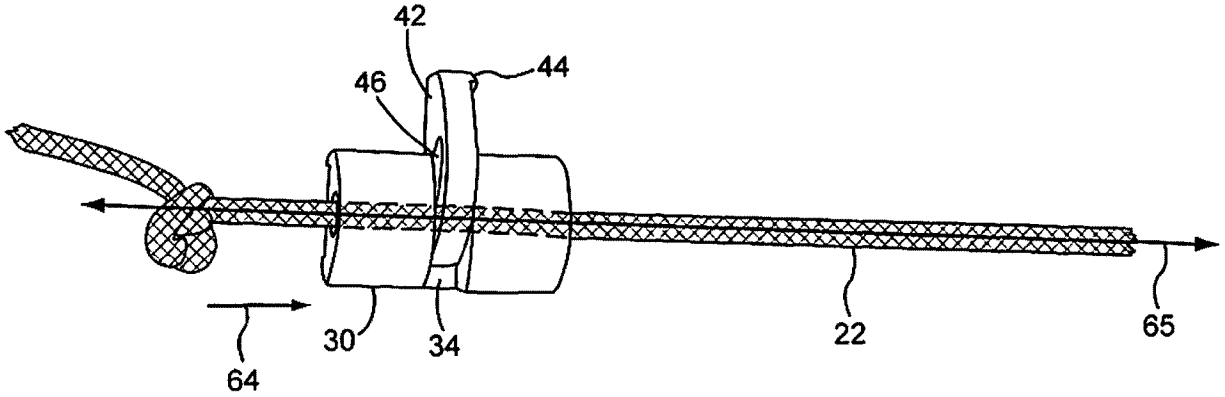
FIG. 8A is a representative top view of an exemplary lift cord, an exemplary base member, and an exemplary selective locking member, like those in FIG. 7, illustrating the exemplary selective locking member in the open position so that the exemplary lift cord can be moved to adjust an architectural opening covering.
Figure 8B:
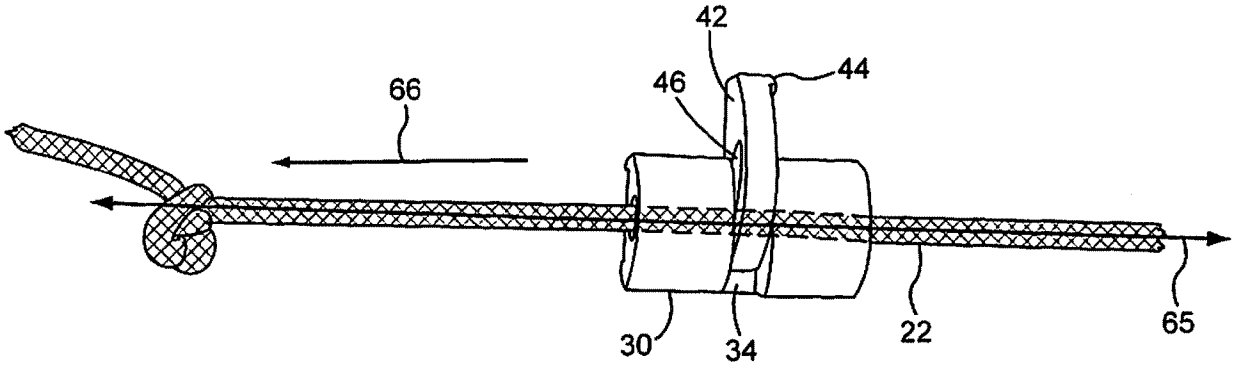

FIG. 8B is a representative top view of an exemplary lift cord, an exemplary base member, and an exemplary selective locking member, like those in FIG. 7, illustrating the exemplary selective locking member in the open position so that the exemplary lift cord can be moved to adjust an architectural opening covering, wherein the lift cord has been pulled down as compared to FIG. 8A, and wherein the exemplary base member and exemplary selective locking member have moved up the lift cord with respect to the bottom of the lift cord.

Figure 9A:
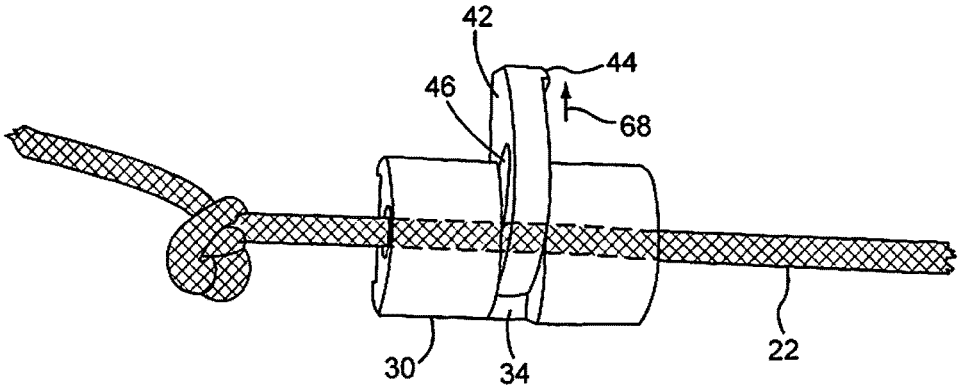

FIG. 9A is a representative top view of an exemplary lift cord, an exemplary base member, and an exemplary selective locking member, illustrating how the exemplary selective locking member can be moved from a closed position to an open position to allow for adjustment of the exemplary lift cord.

Figure 9B:
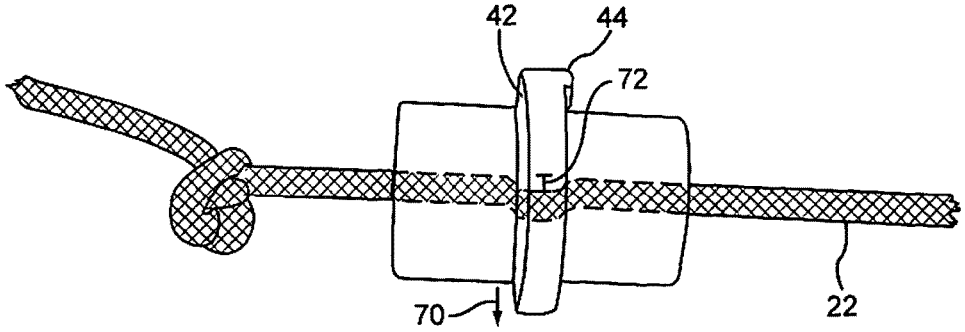

FIG. 9B is a representative top view of an exemplary lift cord, an exemplary base member, and an exemplary selective locking member, illustrating how when the exemplary selective locking member is moved to a closed position, the lift cord is pinched and held in a locked position and cannot be moved up or down.

DETAILED DESCRIPTION

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

Embodiments disclosed in the present Specification relate to an apparatus for selectively locking a lift cord configured to raise or lower a covering for an architectural opening, such as a window, door, or the like. In particular, embodiments disclosed in the present description relate to a selective locking member to be used in conjunction with a base member positioned at a bottom of a covering for an architectural opening, such as a window, door, portal, or the like. The selective locking member is configured to selectively engage the base member and the lift cord. The selective locking member has an opening through which the lift cord may pass. The base member also has at least one opening through which the lift cord may pass. The selective locking member has at least one edge configured to engage a bottom of a groove in the base member. The selective locking member is configured to engage the base member and the lift cord in such a way that the selective locking member can be selectably moved into an open position or a closed position. When the selective locking member is in the open position, the lift cord can be moved freely. When the selective locking member is in the closed position, the selective locking member will pinch the lift cord between the selective locking member and the base member so that the lift cord is prevented from being moved.

In yet another embodiment, a system for selectively locking a lift cord designed to lift coverings for architectural openings is disclosed. The system comprises a covering for an architectural opening that is configured to be attached to a head rail and to be raised or lowered by at least one lift cord. The system also includes a selective locking member and a base member, each having an opening configured to receive the at least one lift cord. In one embodiment, the selective locking member and a base member are located near a bottom end of the architectural opening covering. The selective locking member is configured to selectively engage the base member and the lift cord. The selective locking member has at least one substantially flat edge configured to engage a bottom of a groove in the base member. The selective locking member is configured to engage the base member and the lift cord in such a way that the selective locking member can be selectably moved into an open position and a closed position. When the selective locking member is in the open position, the lift cord can be freely moved. When the selective locking member is in the closed position, the selective locking member will pinch the lift cord between the selective locking member and the base member so that the lift cord is prevented from being moved.

The advantages and features of the embodiments disclosed herein are further illustrated with reference to the following disclosure, which is not to be construed as in any way limiting the scope of the invention but rather as illustrative of the invention in a specific application thereof.

Figure 1A:
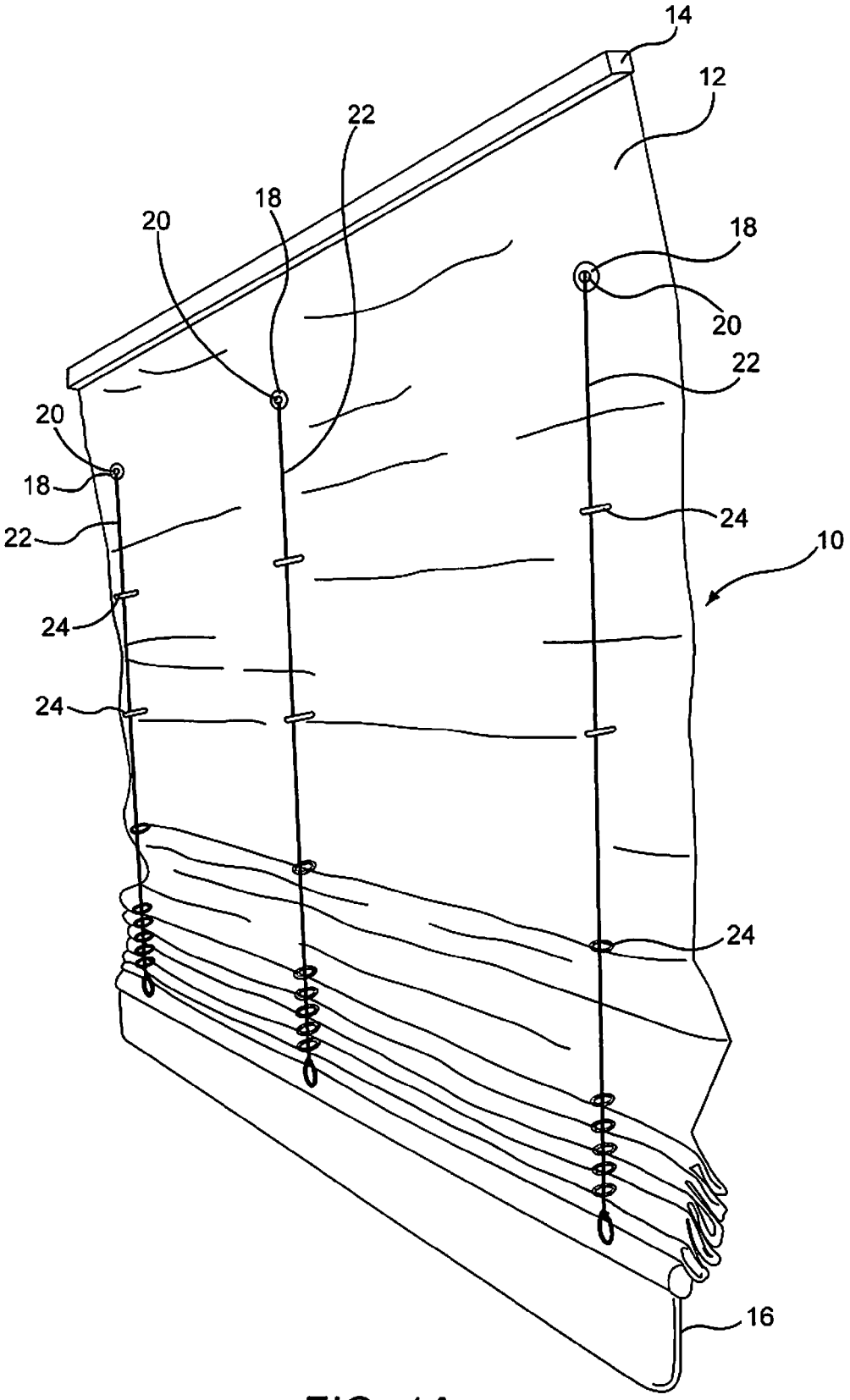
FIG. 1A (PRIOR ART)
FIG. 1A is a representative back view of a prior art architectural opening covering system that uses lift cords.

FIG. 1A is a representative back view of a prior art architectural opening covering system that uses lift cords. The architectural opening covering system 10 comprises a shade 12 made of any suitable material, including but not limited to fabric, wood, or plastic. In one embodiment, the shade 12 may comprise a lift sheet material with a decorative shade material behind it. The architectural opening covering system 10 includes a support member 14 for attaching to or above a window, door, portal, or other architectural opening. The support member 14 is preferably attached at the top of the architectural opening so that gravity can aid in lowering the covering or shade 12 over the architectural opening. One end of the shade 12 is preferably attached to the support member 14 at one end, and another end of the shade 12 is affixed or engaged in some way to a lift bar 16 at another end. The shade 12 may be affixed or engaged to the support member 14 and the lift bar 16 in any suitable manner, such as with magnetic strips, Velcro® hook and loop fastener members, adhesive, stitching, or a pocket for collecting the lift bar 16 attached to the shade 12 via any suitable means. The shade 12 can be any woven or non-woven material, fabric, or the like.

The shade 12 has grommets 18 surrounding openings 20 for one or more lift cords 22 to pass through the openings 20. The lift cords 22 are attached to the support member 14 and to the lift bar 16 and are configured to lift the shade 12 when actuated. The lift cords 22 may be actuated by any known method, including a roller or crank mechanism (not shown). The shade 12 may also have one or more guide rings 24 that the lift cord 22 passes through to aid in the rising and lowering of the shade 12. The guide rings 24 allow the lift cord 22 to pass through as the lift cord 22 moves to raise or lower the shade 12. As the shade 12 is drawn upwards by the lift cord 22 passing through the guide rings 24, the guide rings 24 stack on top of each other and raise the shade 12 upwardly into folded layers stacked in an accordion fashion (see bottom of FIG. 1A). As pictured in FIG. 1A, there are three lift cords 22 and three rows of guide rings 24, with 8 guide rings in each row. However, depending on the size and type of architectural opening covering, any number of lift cords 22 may be used, with any number of rows and any number of guide rings in each row.

Figure 1B:
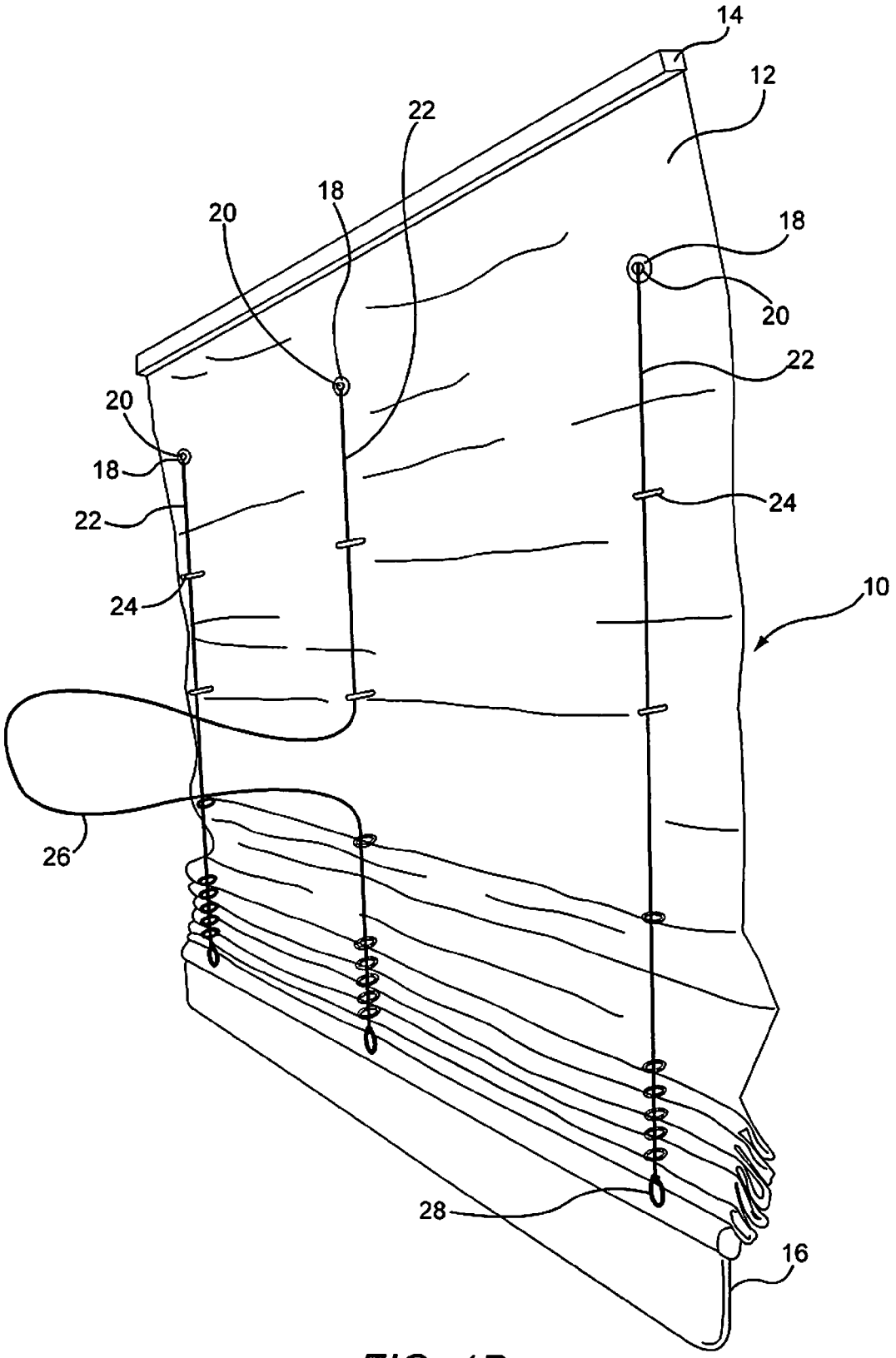
FIG. 1B (PRIOR ART)
FIG. 1B is a representative side view of the prior art architectural opening covering system of FIG. 1A illustrating how hazardous loops can be formed by the lift cords of the prior art.

FIG. 1B is a representative side view of the prior art architectural opening covering system 10 of FIG. 1 illustrating how hazardous loops can be formed by the lift cords of the prior art. Due to the slack necessary to allow the lift cords 22 to raise and lower the shade 12 in the prior art architectural opening covering system 10, the lift cords 22 may be able to be pulled out away from the shade 12 to a distance that allows a hazardous loop 26 to be formed. A loop is considered to be a hazardous loop per the Consumer Product Safety Commission when the loop has a diameter of approximately twelve (12) inches, sufficient for a small child to get their head tangled inside. Some industry standards consider a loop of approximately seven and one half (7.5) inches to be hazardous. The art is therefore in need of systems and methods to allow the lifting of shades without creating a hazardous loop by the lift cords. In one embodiment, the loop should be smaller than the listed diameters when approximately ten (10 pounds) of push force or approximately five (5) pounds of pull force is exerted on the lift cord.

The bottom of the lift cords 22 may be tied to a ring 28, or some other fastening mechanism, such as an orb with a spring inside. If the length of the lift cord 22 needs to be adjusted, such as during installation of the architectural opening covering system 10, a knot has to be untied from the ring 28, or the spring in the orb must be squeezed to allow the lift cord to be adjusted. These methods are time consuming and are difficult to do quickly and efficiently. For example, when adjusting the length of a lift cord 22 in these prior art systems, the shade 12 may become uneven.

These issues may be addressed by the use of the exemplary base member and exemplary selective locking member disclosed herein.

Figure 2A:
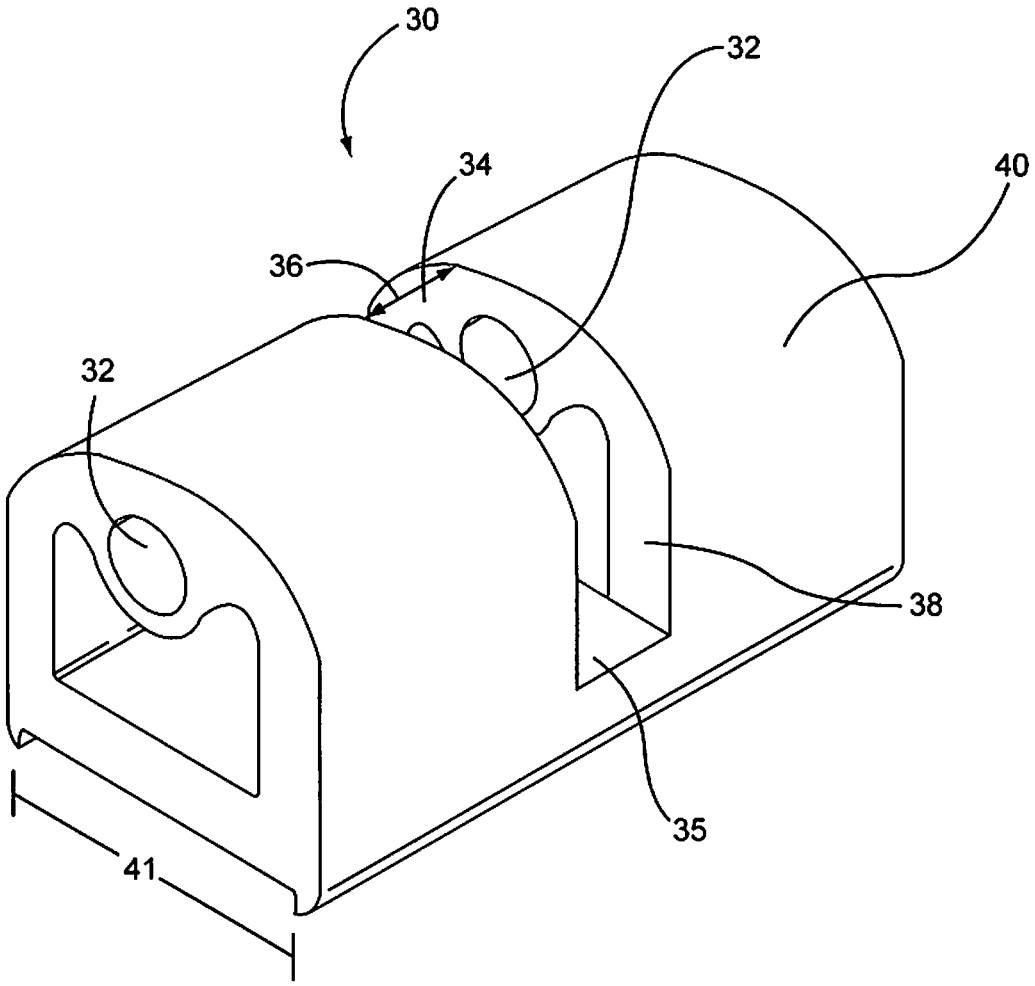
FIG. 2A is a representative front view of an exemplary base member used in one embodiment of an exemplary system for selectably locking lift cords used in architectural opening covering systems.
Figure 2B:
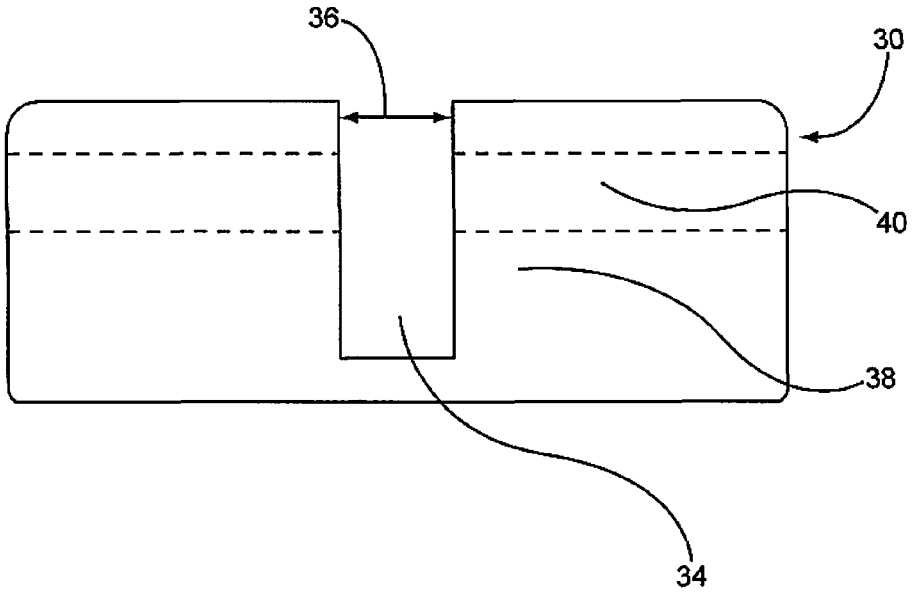
FIG. 2B is a representative sectional end view of the exemplary base member shown in FIG. 2A.
Figure 2C:
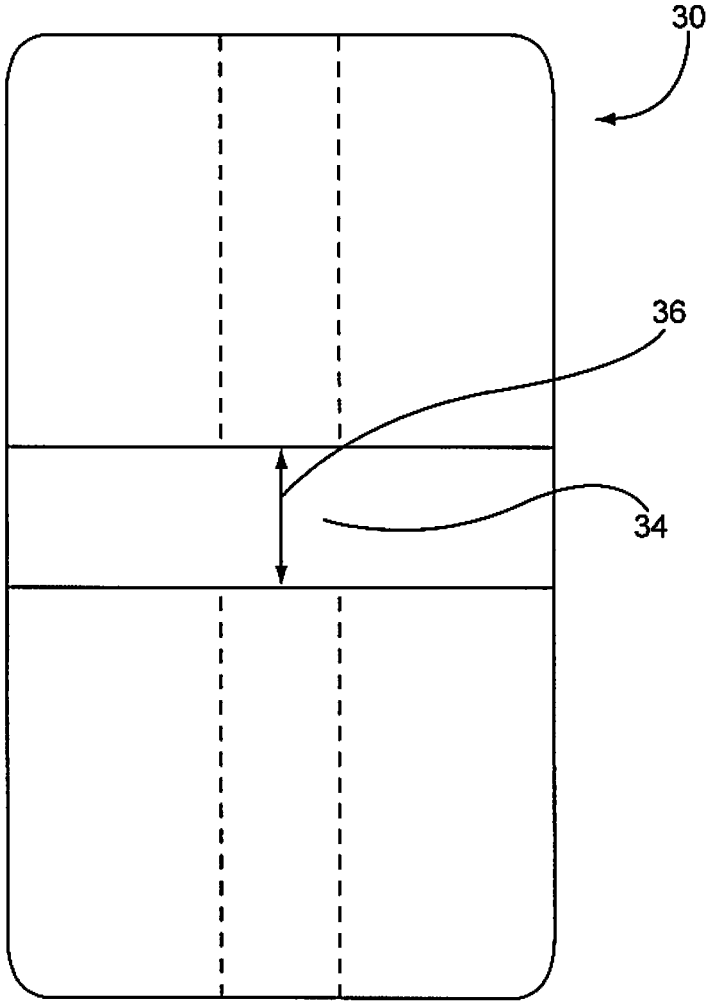
FIG. 2C is a representative top view of the exemplary base member shown in FIG. 2A.

FIGS. 2A-2C illustrate various views of an exemplary base member 30. In the embodiment shown in FIGS. 2A-2C, the base member 30 is a unitary member. FIG. 2A is a representative front view of an exemplary base member 30 used in one embodiment of an exemplary system for locking lift cords used in architectural opening covering systems. FIG. 2B is a representative sectional end view of the exemplary locking member shown in FIG. 2A. FIG. 2C is a representative top view of the exemplary base member shown in FIG. 2A.

Referring to FIGS. 2A-2C, the base member 30 comprises openings 32 configured to receive a lift cord 22 and allow the lift cord 22 to pass freely through the openings 32 in a first direction. The base member 30 also comprises a groove 34 that has a bottom 35 and a width 36. In one embodiment, the bottom 35 of the groove 34 is substantially flat. In one embodiment, the width 36 of the groove 34 is selected to correspond to a thickness 54 of a selective locking member 42 (see FIGS. 3A and 3B) such that the selective locking member 42 can fit snugly into the groove 34 of the base member 30, when the selective locking member 42 is engaged with the base member 30 in a closed position. The base member 30 may also have a first interior wall 38 and a second interior wall 40 in one embodiment. The first interior wall 38 and a second interior wall 40 can be formed when the base member 30 is machined or otherwise manufactured. The first interior wall 38 and a second interior wall 40 may be formed to each have an angle sufficient to allow the selective locking member 42 to rotate within the groove 34 of the base member 30 when the selective locking member 42 is not in a closed or locked position. In one embodiment, the first interior wall 38 has an angle of approximately twenty-one (21) degrees and the second interior wall 40 has an angle of approximately thirty-five (35) degrees. In one embodiment, the base member 30 may have a width 41.

Figure 3A:
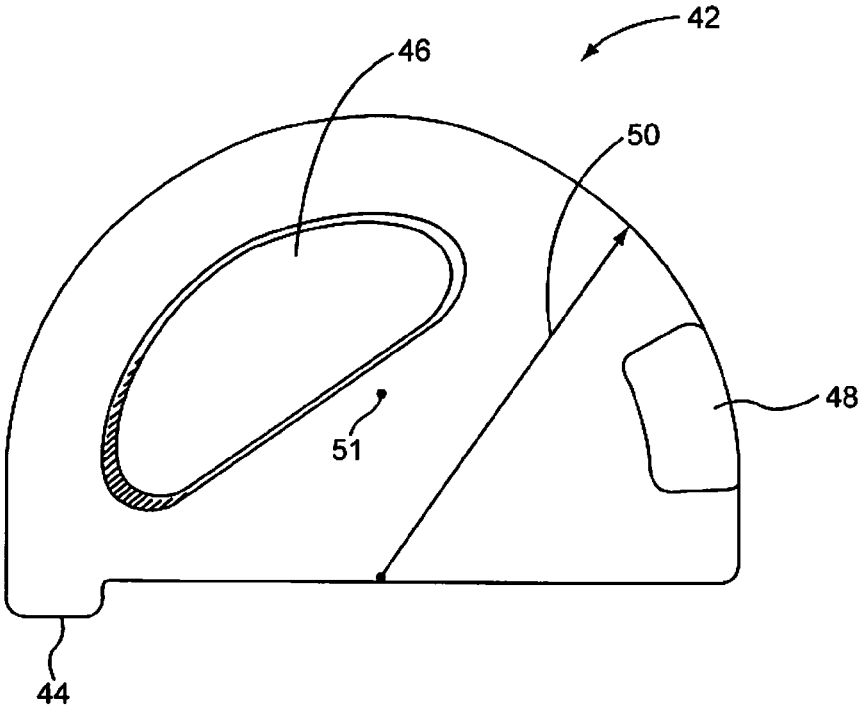
FIG. 3A is a representative front view of an exemplary selective locking member used in one embodiment of an exemplary system for locking lift cords used in architectural opening covering systems.

FIG. 3A is a representative front view of an exemplary selective locking member used in one embodiment of an exemplary system for locking lift cords used in architectural opening covering systems.

Figure 3B:
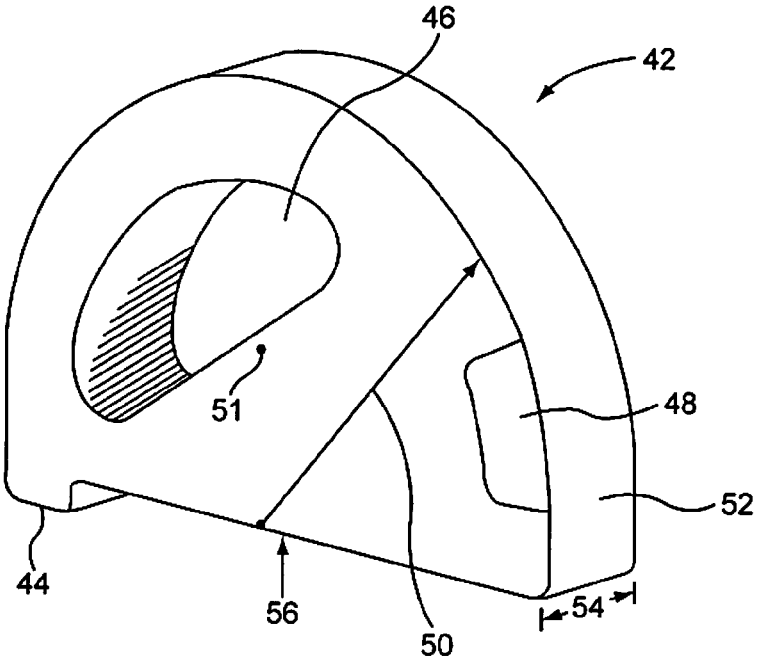
FIG. 3B is a representative side view of the exemplary selective locking member shown in FIG. 3A.

FIG. 3B is a representative side view of the exemplary selective locking member shown in FIG. 3A.

FIGS. 3A and 3B illustrate one embodiment of an exemplary selective locking member for locking lift cords used in architectural opening covering systems. The selective locking member 42 may be made of any suitable material, including but not limited to plastic, wood, or metal, including but not limited to brass. In addition, the selective locking member 42 is mostly a semicircle shape, with a tab 44 extending off one corner of the semi-circular selective locking member 42, but any other suitable shape may be used, including but limited to square, rectangular, or D-shaped selective locking members. The selective locking member 42 comprises an opening 46 configured to allow a lift cord, such as lift cord 22, to pass through the opening 46. In one embodiment, the opening 46 may be oblong shaped, though the opening 46 may be other shapes.

In one embodiment, the selective locking member 42 may also comprise a protrusion 48. The protrusion 48 is used to help snap the selective locking member 42 into the groove 34 of the base member 30 and lock the selective locking member 42 into a closed position. The protrusion 48 may be very slight in one embodiment.

In one embodiment, the selective locking member 42 has an outer diameter 50.

In one embodiment, the opening 46 may be offset from a center 51 of the selective locking member 42 such that the opening 46 is closer to one side of the selective locking member 42 than to the opposite side of the selective locking member 42.

Referring to FIG. 3B, the selective locking member 42 has an outer edge 52 having a thickness 54, which may be any suitable thickness, and an outer diameter 50, which may be of any suitable diameter. In one embodiment, the thickness 54 is chosen so that the selective locking member 42 will fit snugly into the groove 34 of the base member 30 when the selective locking member 42 is in a closed or locked position. In one embodiment, the outer diameter 50 of the selective locking member 42 is chosen to be slightly larger than a width 41 of the base member 30 so that it may fit snugly around the base member 30. In one embodiment, the selective locking member 42 has an edge 56 which is configured to correspond and mate to the bottom 35 of the groove 34 of the base member 30. In one embodiment, the edge 56 may be substantially flat to correspond and mate to the bottom 35.

The base member 30 of FIGS. 2A-2C may be used in conjunction with the selective locking member 42 of FIGS. 3A and 3B and a lift cord like the lift cords 22 shown in FIGS. 1A and 1B. The selective locking member 42 is configured to selectively engage the base member 30 and the lift cord 22. The selective locking member 42 has an opening 46 through which the lift cord 22 may pass. The base member 30 also has one or more openings 32 through which the lift cord 22 may pass. The selective locking member 42 has at least one edge 56 configured to mate to a bottom 35 of the groove 34 in the base member 30. In one embodiment, both the edge 56 and the bottom 35 of the groove 34 are substantially flat. The selective locking member 42 is configured to engage the base member 30 and the lift cord 22 in such a way that the selective locking member 42 can be selectably moved into an open position and a closed position. When the selective locking member 42 is in the open position, the lift cord 22 can be freely moved to adjust the length of the lift cord 22. When the selective locking member 42 is in the closed position, the selective locking member 42 will pinch the lift cord 22 between the selective locking member 42 and the base member 30 so that the lift cord 22 is locked and cannot be moved.

Figure 4:
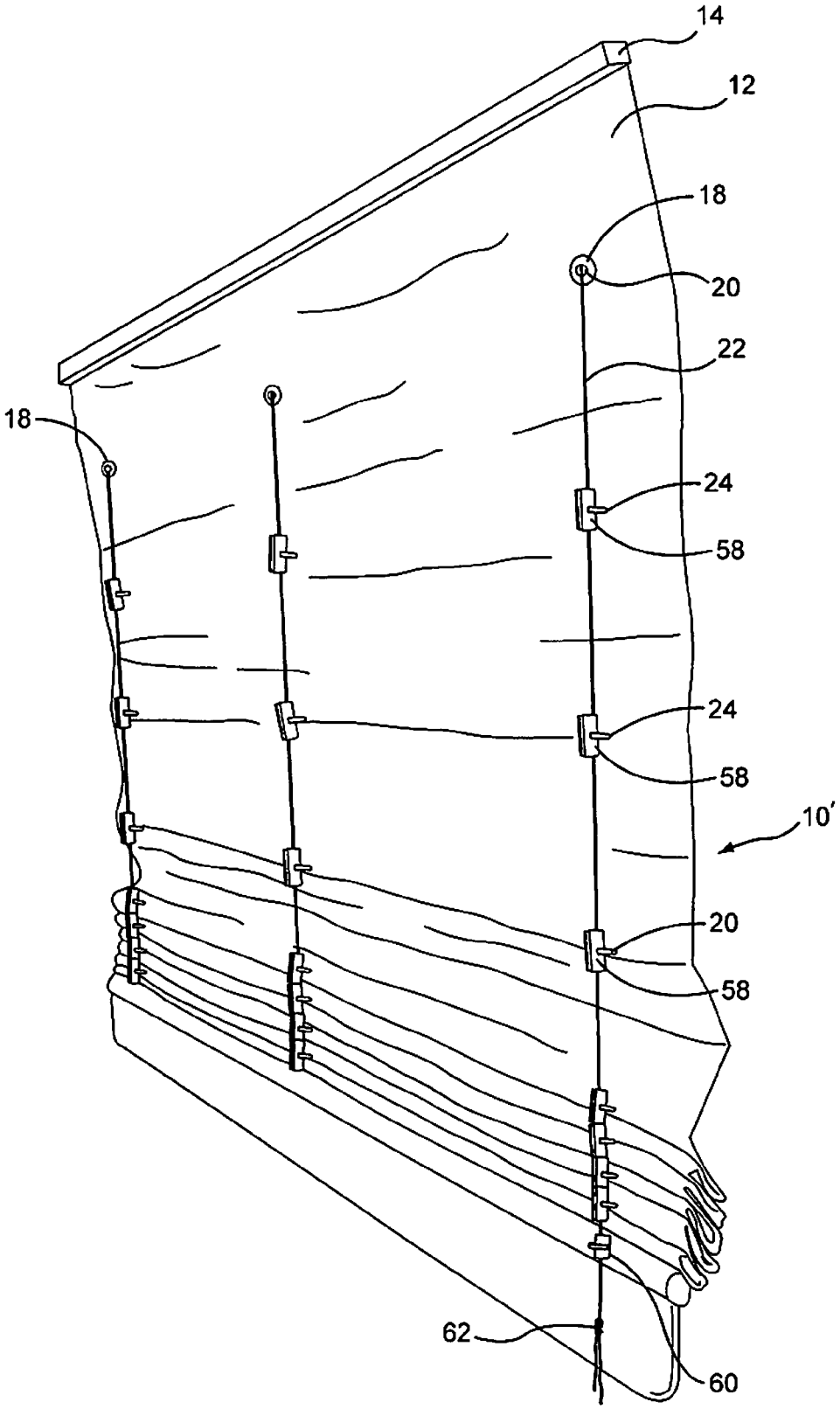
FIG. 4 is a representative back view of an exemplary shade having a plurality of lift cords and a plurality of guide rings in conjunction with locking members, with an exemplary base member/selective locking member combination like those illustrated in FIGS. 2A-3B located near a bottom of one of the lift cords.

FIG. 4 is a representative back view of an exemplary architectural opening covering system 10' and a plurality of lift cords 22. The architectural opening covering system 10' may also have a plurality of guide rings 24 in conjunction with exemplary locking members 58 like those described in U.S. patent application Ser. No. 13/738,387, filed Jan. 10, 2013, entitled "Apparatuses, Systems and Methods for Locking Lift Cords Used to Lift Architectural Opening Coverings", now issued as U.S. Pat. No. 8,540,006, which is incorporated herein by reference. As described in U.S. Pat. No. 8,540,006, a plurality of exemplary locking members 58, are used in an exemplary architectural opening covering system 10', as depicted from the back side. A locking member 58 is used in conjunction with each of the guide rings 24 and one or more lift cords 22. Each of the locking members 58 is configured to engage the guide ring 24 and the lift cord 22. The locking member 58 is configured to engage the guide ring 24 and the lift cord 22 in such a way that the locking member 58 has a selective rotative ability, which allows the lift cord 22 to freely move in a first direction to raise or lower a shade or other architectural opening covering. In one embodiment, the first direction is a vertical, or substantially vertical direction, that allows the lift cord 22 to raise or lower the shade 12.

However, when the lift cord 22 is pulled in a second direction, the locking member 58 is configured to rotate about the guide ring 24 to pinch the lift cord 22 between the locking member 58 and the guide ring 24 so that the lift cord 22 is prevented from being pulled away from the covering far enough to create a loop of a certain diameter. In one embodiment, the second direction is any direction other than a vertical, or substantially vertical direction, that allows the lift cord 22 to raise or lower the shade 12. In another embodiment, the second direction is a horizontal, or substantially horizontal direction. In one embodiment, due to the locking members 58 pinching the lift cord 22 when it is pulled in a direction other than the first direction, the locking members 58 will not allow the lift cord 22 to be pulled far enough away from the shade 12 to create a loop of more than seven and one half (7.5) inches in diameter. In another embodiment, due to the locking members 58 pinching the lift cord 22 when it is pulled in a direction other than the first direction, the lift cord 22 will not be capable of being pulled far enough away from the shade 12 to create a loop of more than two to three (2-3) inches in diameter. The locking member 58 thus engages the guide ring 24 in such a way that the locking member 58 has a selective rotative ability, which allows the lift cord 22 to freely move in a first direction to raise or lower the covering (e.g., the shade 12), but will rotate about the guide ring 24 when the lift cord 22 is pulled in a second direction to pinch the lift cord 22 between the locking member 58 and the guide ring 24 so that the lift cord 22 is prevented from being pulled away from the covering far enough to create a loop of a certain diameter that might pose a hazard.

The base member 30 and the selective locking member 42 disclosed herein can be used together with the rings 24 and the locking members 58 in a system like the system disclosed in U.S. Pat. No. 8,540,006. Referring back to FIG. 4, a level locking mechanism 60 can be positioned near a bottom 62 of the lift cord 22 in place of the ring 28 or orb with a spring used in prior art systems. The level locking mechanism 60 comprises a base member 30 and a selective locking member 42 like those disclosed herein (see FIGS. 2A-3B).

Figure 5:
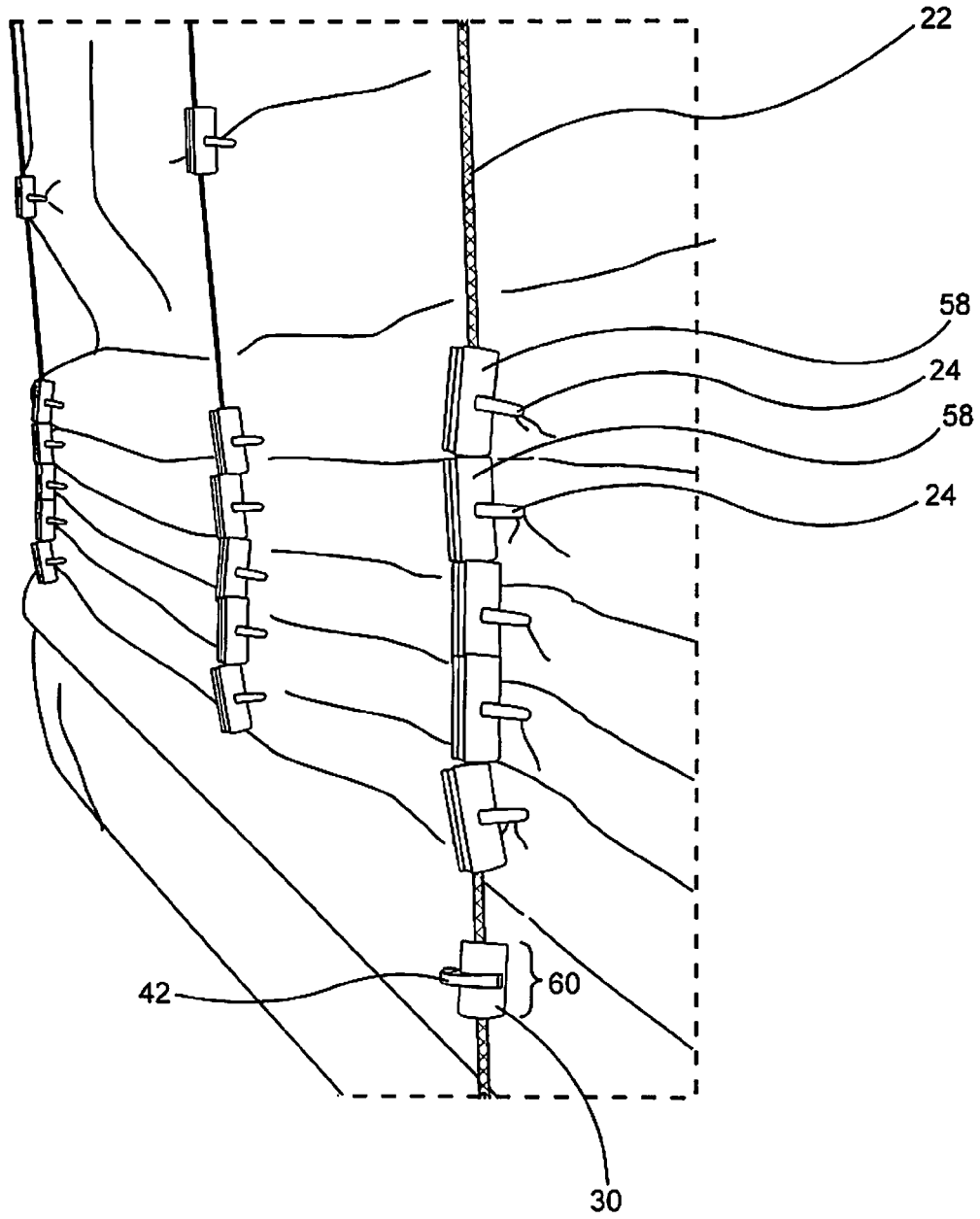
FIG. 5 is a close up representative side view of the exemplary shade of FIG. 4 in a partially lifted position, illustrating an exemplary lift cord, exemplary guide rings/locking members, and an exemplary base member/selective locking member combination.

FIG. 5 is a close up representative side view of the exemplary architectural opening covering system 10 of FIG. 4 in a partially lifted position, illustrating an exemplary lift cord, an exemplary base member, and an exemplary selective locking member. FIG. 5 is a close up view of the exemplary architectural opening covering system 10' shown in FIG. 4, depicting a lift cord 22 having been pulled up to partially raise the shade 12. As seen in FIG. 5, the guide rings 24 and the locking members 58 have stacked on top of each other, raising the shade 12 upwardly into folded layers stacked in an accordion fashion. In addition, the locking members 58 have selectively rotated about the guide rings 24 so that the lift cord 22 is prevented from being pulled away from the covering far enough to create a loop of a certain diameter that might pose a hazard.

In the exemplary architectural opening covering system 10' of FIGS. 4 and 5, there may be a time, such as during installation, or at a later time, that it may be desirable to adjust the length of the lift cord 22. The base member 30 and the selective locking member 42 disclosed herein make adjusting the length of the lift cord easy and efficient, allowing the shade 12 to remain level.

Figure 6:
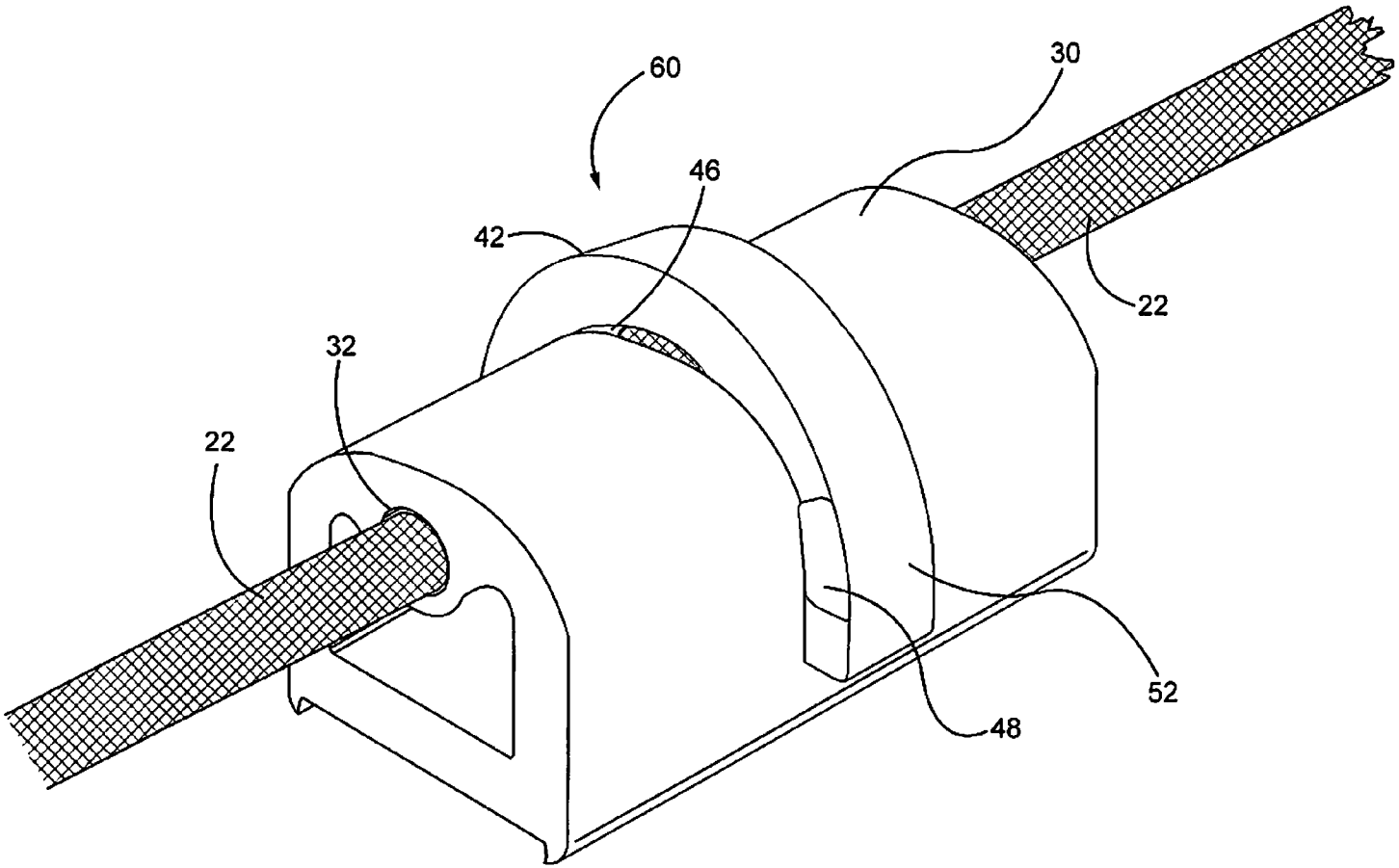
FIG. 6 is a close up representative side view of an exemplary lift cord, an exemplary base member, and an exemplary selective locking member, illustrating the exemplary selective locking member engaged with the base member in a closed position.

Referring now to FIG. 6, FIG. 6 is a close up representative side view of an exemplary lift cord and an exemplary level locking mechanism comprising a base member and an exemplary selective locking member, illustrating the exemplary selective locking member engaged with the base member in a closed position. A level locking mechanism 60 comprises a base member 30 and a selective locking member 42. In one embodiment, the selective locking member 42 and the base member 30 may be slid onto the lift cord 22, wherein the lift cord 22 passes through the opening 32 of the base member 30 and the opening 46 of the selective locking member 42. In one embodiment, after the selective locking member 42 and the base member 30 are slid onto the lift cord 22, a knot may be tied on the end of the lift cord 22 to keep the selective locking member 42 and the base member 30 on the lift cord 22.

As discussed above with respect to FIGS. 2A-3B, the selective locking member 42 has an outer edge 52 which is sized to fit snugly into the groove 34 of the base member 42, and the outer diameter 50 of the selective locking member 42 is chosen to be slightly larger than a width 41 of the base member 30 so that it may fit snugly around the base member 30. In one embodiment, a person may position the selective locking member 42 so that the edge 56 corresponds to the bottom 35 of the groove 34 of the base member 30 and the outer edge 52 of the selective locking member 42 fits snugly into the groove 34 of the base member 30. The person may then apply a pushing force to slide the edge 56 of the selective locking member 42 along the bottom 35 of the groove 34 of the base member 30 until the selective locking member 42 snaps into a locked position with the base member 30.

In one embodiment, the selective locking member 42 has an edge 56 which is configured to correspond and mate to the bottom 35 of the groove 34 of the base member 30. In one embodiment, the edge 56 may be substantially flat to correspond and mate to the bottom 35. In one embodiment, a protrusion 48 is used to help snap the selective locking member 42 into the groove 34 of the base member 30 and lock the selective locking member 42 into a closed position. Note that in the closed position as shown in FIG. 6, the protrusion 48 is in contact with an outer portion of the base member 30. When the selective locking member 42 is in the closed position, the selective locking member 42 will pinch the lift cord 22 between the selective locking member 42 and the base member 30 so that the lift cord 22 is prevented from being pulled up or down.

Referring now to FIG. 7, the selective locking member 42 can be moved from the closed position shown in FIG. 6 to an open position. FIG. 7 is a close up representative side view of an exemplary lift cord and an exemplary level locking mechanism comprising an exemplary base member and an exemplary selective locking member, illustrating the exemplary selective locking member disengaged from the base member in an open position. Comparing FIG. 7 to FIG. 6, the selective locking member 42 has been moved to the right, as evidenced by the fact that the protrusion 48 is now not touching an outer portion of the base member 30 and more of the opening 46 of the selective locking member 42 is visible. In one embodiment, the selective locking member 42 can be moved from the closed position to the open position by a person using their fingernail or small tool to lift up on the tab 44 extending off one corner of the selective locking member 42 and then pushing the selective locking member 42 to one side. When the selective locking member 42 is in the open position, the lift cord 22 can be freely moved to adjust the length of the lift cord 22, and/or to raise or lower the shade 12, as indicated by the double-headed arrow 63.

The free movement of the lift cord 22 when the selective locking member 42 is in the open position is further illustrated in FIGS. 8A and 8B.

FIG. 8A is a representative top view of an exemplary lift cord, an exemplary base member, and an exemplary selective locking member, like those in FIG. 7, illustrating the exemplary selective locking member in the open position so that the exemplary lift cord can be moved to adjust an architectural opening covering.

FIG. 8B is a representative top view of an exemplary lift cord, an exemplary base member, and an exemplary selective locking member, like those in FIG. 7, illustrating the exemplary selective locking member in the open position so that the exemplary lift cord can be moved to adjust an architectural opening covering.

Referring to FIGS. 8A and 8B, when the selective locking member 42 is in the open position, the lift cord 22 may be adjusted up or down to adjust the length of the lift cord 22 and/or to raise or lower the shade 12. FIG. 8A shows the selective locking member 42 and the base member 30 in a first position approximately a distance 64 from a bottom of the lift cord 22. For example, in one non-limiting embodiment, if it is desired to lengthen the lift cord 22, the lift cord 22 may be pulled downward, as indicated by arrow 66 in FIG. 8B, since the selective locking member 42 is in the open position. Note that in the open position, the lift cord 22 can freely move through the openings 32 of the base member 30 and the opening 46 of the selective locking member 42 along an axis 65 that runs lengthwise through the lift cord 22. When the lift cord 22 is pulled downward, the relative position of the base member 30 and the selective locking member 42 changes with respect to a bottom of the lift cord 22. In one embodiment, if the lift cord 22 is to be shortened, the selective locking member 42 and the base member 30 can be moved in the opposite direction to shorten the lift cord 22.

However, when the selective locking member 42 is moved from the open position to the closed position, the selective locking member 42 pinches the lift cord 22 so that the lift cord 22 is prevented from being pulled to raise or lower the shade 12. This can be seen further in FIGS. 9A and 9B.

FIG. 9A is a representative top view of an exemplary lift cord, an exemplary base member, and an exemplary selective locking member, illustrating how the exemplary selective locking member can be moved from a closed position to an open position to allow for adjustment of the exemplary lift cord. In FIG. 9B, the selective locking member 42 has been moved by a person using their fingernail or small tool to lift up on the tab 44 extending off one corner of the selective locking member 42 and then pushing the selective locking member 42 to one side, as evidenced by arrow 68. As discussed above, when the selective locking member 42 is in the open position, the lift cord 22 can freely move through the openings 32 of the base member 30 and the opening 46 of the selective locking member 42 along the axis 65.

However, once the lift cord 22 has been adjusted to the desired length, the selective locking member 42 can be moved back to the closed position in order to again pinch the lift cord 22 between the selective locking member 42 and the base member 30 so that the lift cord 22 is prevented from being pulled to raise or lower the covering, as shown in FIG. 9B. In the closed position, the base member 30 and the selective locking member 42 cannot be moved along the lift cord 22.

FIG. 9B is a representative top view of an exemplary lift cord, an exemplary base member, and an exemplary selective locking member, illustrating how when the exemplary selective locking member is moved to a closed position, the lift cord is pinched and held in a locked position and cannot be moved up or down.

In one embodiment, a person may position the selective locking member 42 so that the edge 56 corresponds to the bottom 35 of the groove 34 of the base member 30 and the outer edge 52 of the selective locking member 42 fits snugly into the groove 34 of the base member 30. The person may then apply a pushing force to slide the edge 56 of the selective locking member 42 along the bottom 35 of the groove 34 of the base member 30 to snap the selective locking member 42 into a locked position with the base member 30. When the selective locking member 42 is pushed into the closed position, as indicated by the arrow 70 in FIG. 9B, the lift cord 22 is pinched by the opening 46 of the selective locking member 42 as the selective locking member 42 is pushed into the closed position, causing a portion of the lift cord 22 to move a slight distance 72 away from an axis running lengthwise through the lift cord, as indicated in FIG. 9B. This will cause the lift cord 22 to move off of the axis 65 shown in FIG. 9A. This pinching of the lift cord 22 by the selective locking member 42 will hold the lift cord 22 in a locked position where the lift cord 22 cannot be moved up and down until the selectable locking member 42 is placed into the open position.

In this manner, the selectable locking member 42 can be moved into an open position when a length of the lift cord 22 needs to be adjusted, and once the lift cord 22 has been adjusted, the selectable locking member 42 can be moved back to the closed position so that the lift cord 22 is held in a locked position where it cannot be moved. This allows the architectural opening covering to be held level, while still allowing for the lift cord to be adjusted as necessary to allow efficient and easy raising and lowering of the architectural opening covering Although the embodiments disclosed herein have been illustratively described with respect to various embodiments for window openings or other architectural openings, it will be recognized that the cover assembly can be advantageously utilized as a covering for any indoor or outdoor passage, portal, gate opening, or the like. For example, the cover assembly in other embodiments can be used as a closure for a tent or cabana or a decorative screen or partition that may be deployed with an associated frame, to provide a freestanding room divider, privacy screen, sun-blocking structure, or the like.

While the embodiments disclosed herein have been described herein in reference to specific aspects, features and illustrative embodiments, it will be appreciated that the utility of the invention is not thus limited, but rather extends to and encompasses numerous other variations, modifications and alternative embodiments, as will suggest themselves to those of ordinary skill in the field of the present invention, based on the disclosure herein. Correspondingly, the invention as hereinafter claimed is intended to be broadly construed and interpreted, as including all such variations, modifications and alternative embodiments, within its spirit and scope.

Those skilled in the art will recognize improvements and modifications to the preferred embodiments of the present disclosure. All such improvements and modifications are considered within the scope of the concepts disclosed herein and the claims that follow.

What is claimed is:

1. An apparatus for selectively locking a lift cord designed to lift coverings for architectural openings, comprising:

a base member having a groove with a bottom, and at least one base opening, wherein the at least one base opening is configured to receive the lift cord such that the lift cord passes through the base member; and a unitary single piece locking member having at least one edge and a selective locking member opening in a body of the selective locking member, wherein the selective locking member opening is configured to selectively engage the lift cord and the at least one edge is configured to selectively engage the bottom of the groove of the base member, wherein the at least one edge of the selective locking member locks into the bottom of the groove when the selective locking member is in a closed position, wherein the selective locking member is configured to selectively be positioned between an open position and the closed position, wherein when the selective locking member is in the open position and not engaged with the lift cord, the lift cord can be freely moved, and when the selective locking member is in the closed position, the selective locking member will pinch the lift cord between the selective locking member and the base member so that the lift cord cannot be moved.

2. The apparatus of claim 1, wherein the at least one edge of the selective locking member has a thickness that conforms to a width of the groove of the base member.

3. The apparatus of claim 2 wherein the thickness of the at least one edge and the width of the groove of the base member are configured to allow the selective locking member to snugly fit into the groove of the base member when the selective locking member is in the closed position.

4. The apparatus of claim 2 wherein the thickness of the at least one edge and the width of the groove of the base member are configured to allow the selective locking member to rotate within the groove of the base member when the selective locking member is not in the closed position.

5. The apparatus of claim 4, wherein the base member further comprises a first interior wall and a second interior wall, the first interior wall and the second interior wall arranged to allow the selective locking member to move within the groove of the base member when the selective locking member is not in the closed position.

6. The apparatus of claim 1, wherein the at least one edge of the selective locking member is substantially flat, the bottom of the groove of the base member is substantially flat, and the at least one edge of the selective locking member is configured to correspond and mate to the bottom of the groove of the base member when the selective locking member is in the closed position.

7. The apparatus of claim 1, wherein the selective locking member has an outer diameter that is slightly larger than a width of the base member such that the selective locking member fits snugly around an outer portion of the base member when the selective locking member is in the closed position.

8. The apparatus of claim 1, wherein the selective locking member further comprises a tab extending off a corner of the selective locking member, wherein the tab is configured to allow the selective locking member to be disengaged from the base member and to be moved from the closed position to the open position.

9. The apparatus of claim 1, wherein the selective locking member further comprises a protrusion on one side of the selective locking member, the protrusion configured to help snap the selective locking member into the groove of the base member to lock the selective locking member into the closed position.

10. The apparatus of claim 9, wherein the protrusion is in contact with an outer portion of the base member when the selective locking member is in the closed position and does not touch the outer portion of the base member when the selective locking member is in the open position.

11. The apparatus of claim 1, wherein the selective locking member is substantially a semicircular shape.

12. The apparatus of claim 1, wherein the selective locking member opening is offset from a center of the selective locking member, such that the selective locking member opening is closer to one side of the selective locking member than an opposite side.

13. The apparatus of claim 1, wherein when the selective locking member is moved from the open position to the closed position, the selective locking member opening will pinch the lift cord between the locking member and the base member so that a portion of the lift cord is moved at least a distance away from an axis running lengthwise through the lift cord and the lift cord is held in a locked position.

14. The apparatus of claim 1, wherein the base member has a plurality of base openings, each of the plurality of base openings configured to receive the lift cord.

15. A system for selectively locking at least one lift cord designed to lift coverings for architectural openings comprising:

an architectural opening covering configured to be attached to a head rail;

at least one lift cord configured to lift the architectural opening covering;

a base member having a groove with a bottom, and at least one base opening, wherein the at least one base opening is configured to receive the at least one lift cord such that the at least one lift cord passes through the base member; and a unitary single piece locking member having at least one edge and a selective locking member opening in a body of the selective locking member, wherein the selective locking member opening is configured to selectively engage the at least one lift cord and the at least one edge is configured to selectively engage the bottom of the groove of the base member, wherein the at least one edge of the selective locking member locks into the bottom of the groove when the selective locking member is in a closed position, and wherein the base member and the selective locking member are configured to be positioned such that the at least one lift cord passes through the at least one base opening and through the selective locking member opening, and wherein the selective locking member is configured to selectively be positioned between an open position and the closed position, wherein when the selective locking member is in the open position and not engaged with the at least one lift cord, the at least one lift cord can be freely moved, and when the selective locking member is in the closed position, the selective locking member will pinch the at least one lift cord between the selective locking member and the base member so that the at least one lift cord cannot be moved.

16. The system of claim 15, wherein the at least one edge of the selective locking member has a thickness that conforms to a width of the groove of the base member.

17. The system of claim 16 wherein the thickness of the at least one edge and the width of the groove of the base member are configured to allow the selective locking member to snugly fit into the groove of the base member when the selective locking member is in the closed position.

18. The system of claim 15, wherein the at least one edge of the selective locking member is substantially flat, the bottom of the groove of the base member is substantially flat, and the at least one edge of the selective locking member is configured to correspond and mate to the bottom of the groove of the base member when the selective locking member is in the closed position.

19. The system of claim 15, wherein the selective locking member further comprises a tab extending off a corner of the selective locking member, wherein the tab is configured to allow the selective locking member to be disengaged from the base member and to be moved from the closed position to the open position.

20. The system of claim 15, wherein the selective locking member further comprises a protrusion on one side of the selective locking member, the protrusion configured to help snap the selective locking member into the groove of the base member to lock the selective locking member into the closed position.

21. The system of claim 15, wherein when the selective locking member is moved from an open position to a closed position, the selective locking member opening will pinch the at least one lift cord between the locking member and the base member so that a portion of the at least one lift cord is moved at least a distance away from an axis running lengthwise through the at least one lift cord, and the at least one lift cord is held in a locked position.

22. The system of claim 15, further comprising:

a locking member having a locking member groove and at least one locking member opening, wherein the locking member groove is configured to engage a guide ring attached to the architectural opening covering and the at least one locking member opening is configured to receive the at least one lift cord such that the at least one lift cord passes through both the guide ring and the locking member;

wherein the locking member is configured to engage the guide ring and the at least one lift cord such that the locking member allows the at least one lift cord to freely move in and out of the at least one locking member opening in a first direction to raise or lower the architectural opening covering, and the locking member moves about the guide ring when the at least one lift cord is pulled in a second direction to pinch the at least one lift cord between the locking member and the guide ring to prevent the at least one lift cord from being pulled away from the architectural opening covering;

wherein the locking member and the guide ring maintain contact with the at least one lift cord while the at least one lift cord is being pulled in the second direction; and wherein the second direction is different from the first direction.

* * * * *